US007277661B2

(12) United States Patent
Kim et al.

(10) Patent No.: US 7,277,661 B2
(45) Date of Patent: Oct. 2, 2007

(54) IMAGE PHOTOGRAPHING APPARATUS HAVING A DEVELOPING UNIT COMPRISING PLURAL UNITS

(75) Inventors: Young-min Kim, Suwon-si (KR); Joo-hwan Noh, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 155 days.

(21) Appl. No.: 11/064,860

(22) Filed: Feb. 25, 2005

(65) Prior Publication Data

US 2005/0196195 A1 Sep. 8, 2005

(30) Foreign Application Priority Data

Mar. 4, 2004 (KR) ..... 10-2004-0014535

(51) Int. Cl.
*G03G 21/18* (2006.01)

(52) U.S. Cl. ..... 399/113; 399/110; 399/119

(58) Field of Classification Search ..... 399/113, 399/110, 119, 116, 262
See application file for complete search history.

(56) References Cited

U.S. PATENT DOCUMENTS 4,916,490 A * 4/1990 Tanaka et al. ..... 399/119
RE36,301 E * 9/1999 Kai et al. ..... 399/113
6,448,994 B1 * 9/2002 Kim et al. ..... 399/116
6,674,982 B2 * 1/2004 Saitoh et al. ..... 399/110
6,785,492 B2 * 8/2004 Tanizaki et al. ..... 399/113
7,020,416 B2 * 3/2006 Kato et al. ..... 399/110
7,031,637 B2 * 4/2006 Fujita ..... 399/111
7,035,569 B2 * 4/2006 Park ..... 399/116
2002/0031369 A1 * 3/2002 Tokutake et al. ..... 399/110

FOREIGN PATENT DOCUMENTS

| | | |
|---|---|---|
| JP | 05-265264 | 10/1993 |
| KR | 2002-0016389 | 3/2002 |
| KR | 2002-0062037 | 7/2002 |
| KR | 2002-0086833 | 11/2002 |

* cited by examiner

*Primary Examiner*—Susan Lee
(74) *Attorney, Agent, or Firm*—Staas & Halsey LLP

(57) ABSTRACT

An image forming apparatus having a developing unit including a plurality of units. An image forming apparatus includes: a main body having a mounting portion; and a developing unit detachably mounted in the mounting portion and having a first unit separated from the main body, a second unit laterally separated from the first unit, and a holding member for preventing the second unit from being dismounted from the mounting portion prior to the first unit.

13 Claims, 9 Drawing Sheets

IMAGE PHOTOGRAPHING APPARATUS HAVING A DEVELOPING UNIT COMPRISING PLURAL UNITS

CROSS-REFERENCE TO RELATED APPLICATION

This application claims the benefit of Korean Patent Application No. 2004-14535, filed Mar. 4, 2004, in the Korean Intellectual Property Office, the disclosure of which is incorporated herein by reference.

BACKGROUND OF THE INVENTION

1. Field of the Invention

The present invention relates to an image forming apparatus. More particularly, the present invention relates to an image forming apparatus having a developing unit comprising a plurality of units.

2. Description of Related Art

General electrophotographic image forming apparatuses such as a laser beam printer, a light emitting diode printer, a facsimile, a digital photocopier and a multi-function office machine print a digital image signal input from a computer or a scanner in the form of a visible image on a printing medium, such as a paper, through a series of image forming processes.

As shown in FIG. 1, an image forming apparatus generally includes a main body 10 having a front door 11, and a developing unit 15 having a photoconductive drum 17 and detachably mounted in a mounting portion 10*a*. When the developing unit 15 is mounted, the photoconductive drum 17 is mounted to rotate in contact with a transfer roller 14. The transfer roller 14 is supported by a side door unit 12 pivotably mounted at a flank of the main body 10. The side door unit 12 is hinged to open and close the flank side of the main body 10, so as to facilitate removal of a jammed paper and replacement of exhausted parts.

The image forming apparatus operates as follows. The photoconductive drum 17 is uniformly electrified by a developing roller (not shown), and an electrostatic latent image is formed by a light scanned from a laser scanning unit (not shown). A toner is attached onto the electrostatic latent image, thereby forming a visible image. The visible image is transferred to a printing paper which comes from a paper supplying unit 13 and passes through between the transfer roller 14 and the photoconductive drum 17. The printing paper bearing the toner thereon is passed through a fusing unit (not shown) and discharged out to a stacker.

In the general image forming apparatus, for cleaning or fixing of inside of the main body 10, or when the photoconductive drum 17 or the toner is exhausted, the developing unit is replaced as a whole. Such an integral developing unit is usually classified into a uni-structure type wherein all the components such as the photoconductive drum, the developing roller and a toner container are integrally formed, and a dual-structure type has the following two units; a first unit having the toner container and the developing roller; and a second unit having a photoconductive drum 17. FIG. 1 illustrates the latter case of the image forming apparatus in which the developing unit comprises two units. The developing unit 15 of FIG. 1 has a first unit 16 and a second unit 18 mounted in the mounting portion 10*a* of the main body 10 in complementary connection with each other for the image forming operation.

The first unit 16 has the toner container and the developing roller, and the second unit 18 includes the photoconductive drum 17. During separation of the developing unit 15, the first unit 16 having the developing roller and the toner container is separated first. Since the second unit 18 usually has a life span as about 3 to 4 times as that of the first unit 16 in some image forming apparatuses, the first unit 16 needs to be replaced more frequently.

The developing unit 15 includes the first unit 16 and the second unit 18 should be removed in a specified order. This is because the developing roller (not shown) and the photoconductive drum 17 are so delicate that they can be damaged if removed in a different order. In order to separate the developing unit 15, the front door 11 is open, the first unit 16 having the developing roller (not shown) is drawn first, and then the second unit 18 having the photoconductive drum 17 is drawn out. Otherwise, the parts at the contacting surface of the first unit 16 and the second unit 18 may be damaged while assembling and disassembling. More specifically, since the developing unit 15 is mounted and detached in a length direction thereof, main parts such as the photoconductive drum 17 or the developing roller (not shown) are subject to damage due to the elongated contacting surface between the first and the second units 16 and 18. Further, the first unit 16 is disposed relatively lower than the second unit 18 in the developing unit 15. Therefore, if the first unit 16 is separated first, the second unit 18 can be separated together with the first unit 16, being put on the first unit 16, without problem. However, to separate the second unit 18 first, a user only grips the second unit 18 but does not grip the first unit 16. Since the first and the second units 16 and 18 are not engaged with each other, the first unit 16 may drop to the floor and damaged. Moreover, the toner in the toner container may be leaked out when the first unit 16 drops to the floor.

BRIEF SUMMARY

An aspect of the present invention is to solve at least the above problems and/or disadvantages and to provide at least the advantages described below.

An aspect of the present invention is to provide an image forming apparatus having a developing unit which includes at least two units, and a holding member which ensures that the units of the developing unit are dismounted in a fixed order.

According to an aspect of the present invention, there is provided an image forming apparatus including: a main body having a mounting portion; and a developing unit detachably mounted in the mounting portion and having a first unit separated from the main body, a second unit laterally separated from the first unit, and a holding member for preventing the second unit from being dismounted from the mounting portion prior to the first unit.

For separation of the second unit from the main body, the second unit may include a hook operation member which includes a hook for fixing and releasing the second unit with respect to the mounting portion of the main body.

The holding member may be disposed in a gap which is a moving path of the hook operation member to restrain movement of the hook operation member.

The holding member may be disposed at the first unit and protrude on an upper part of the first unit in a substantially vertical direction. The holding member may be a substantially square pole.

According to another aspect of the present invention, there is provided an image forming apparatus having a developing unit, including: a main body having a mounting portion; and a developing unit detachably mounted in the mounting portion, and having a photoconductive drum and a developing roller for supplying a toner to the photoconductive drum. The developing unit includes at least three units and a holding member which dictates a specified order of dismounting the at least three units from the mounting portion.

According to another aspect of the present invention, there is provided a developing unit for an image forming apparatus having a mounting portion which receives the developing unit, including: a first unit having a holding member, a toner container containing toner, and a developing roller; and a second unit having a photoconductive roller. The holding member prevents the second unit from being dismounted from the mounting portion before the first unit.

According to another aspect of the present invention, there is provided a developing unit for an image forming apparatus having a mounting portion which receives the developing unit, including: at least two units which are separable and removable from the mounting portion; and a holding section which dictates a priority of dismounting of the at least two separate units from the mounting portion.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENT

Figure 1:
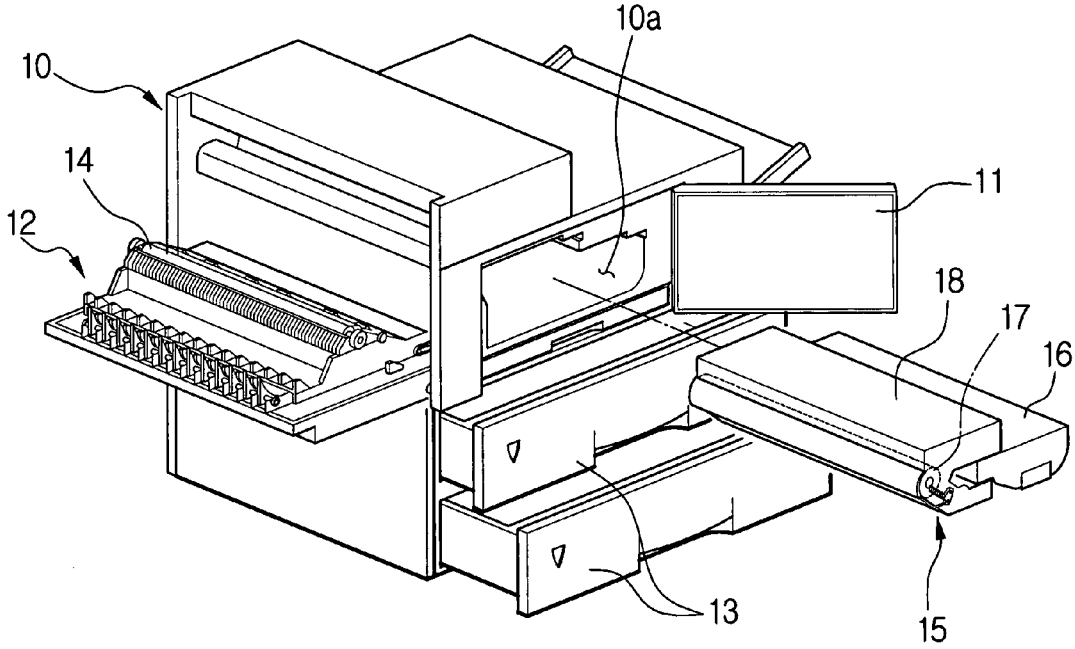
FIG. 1 (PRIOR ART)
FIG. 1 is a schematic perspective view of a conventional image forming apparatus.

Reference will now be made in detail to an embodiment of the present invention, examples of which are illustrated in the accompanying drawings, wherein like reference numerals refer to the like elements throughout. The embodiment is described below in order to explain the present invention by referring to the figures.

A developing unit of an image forming apparatus according to an embodiment of the present invention has a first unit including a photoconductive drum and a second unit including a developing roller and a toner container. In dismounting the developing unit from the image forming apparatus, the first unit precedes the second unit.

Figure 2:
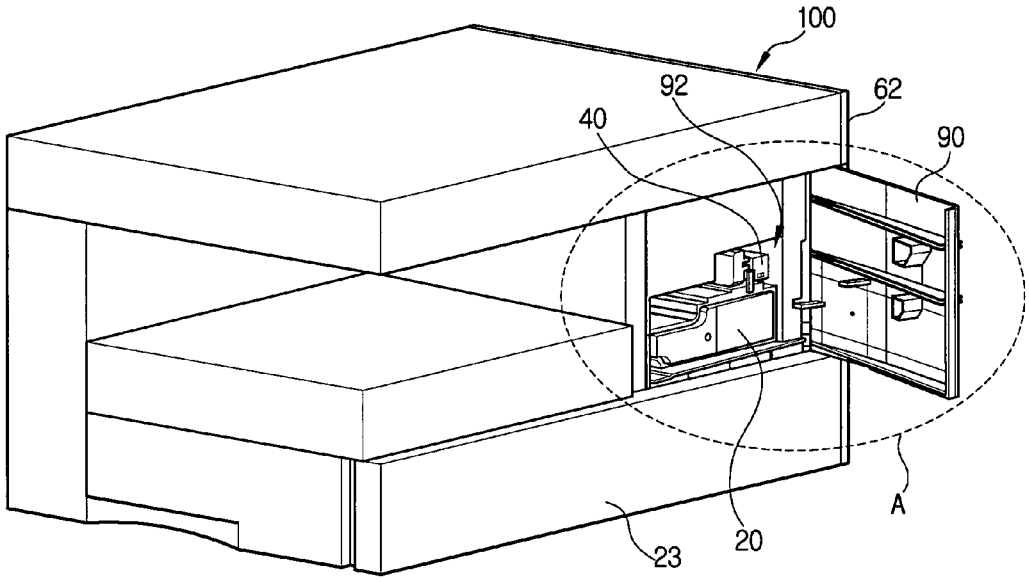
FIG. 2 is a schematic perspective view of an image forming apparatus according to an embodiment of the present invention.
Figure 3:
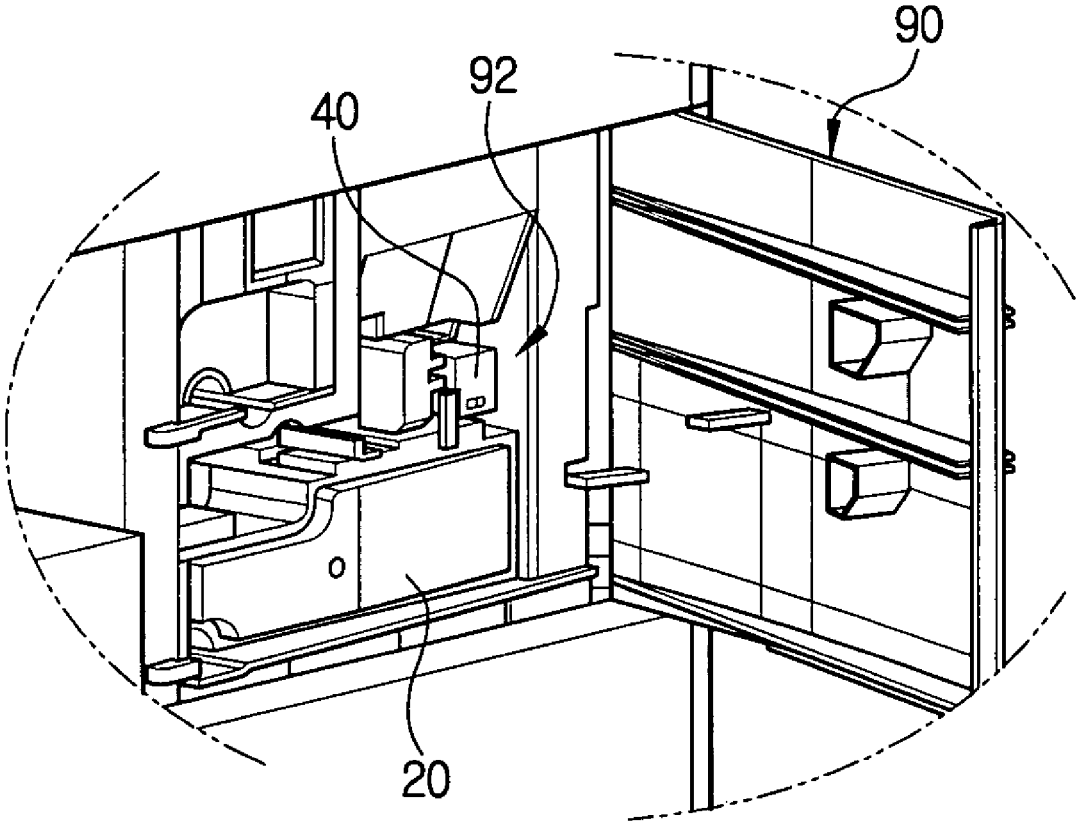
FIG. 3 is an enlarged view of part A in FIG. 2.
Figure 4:
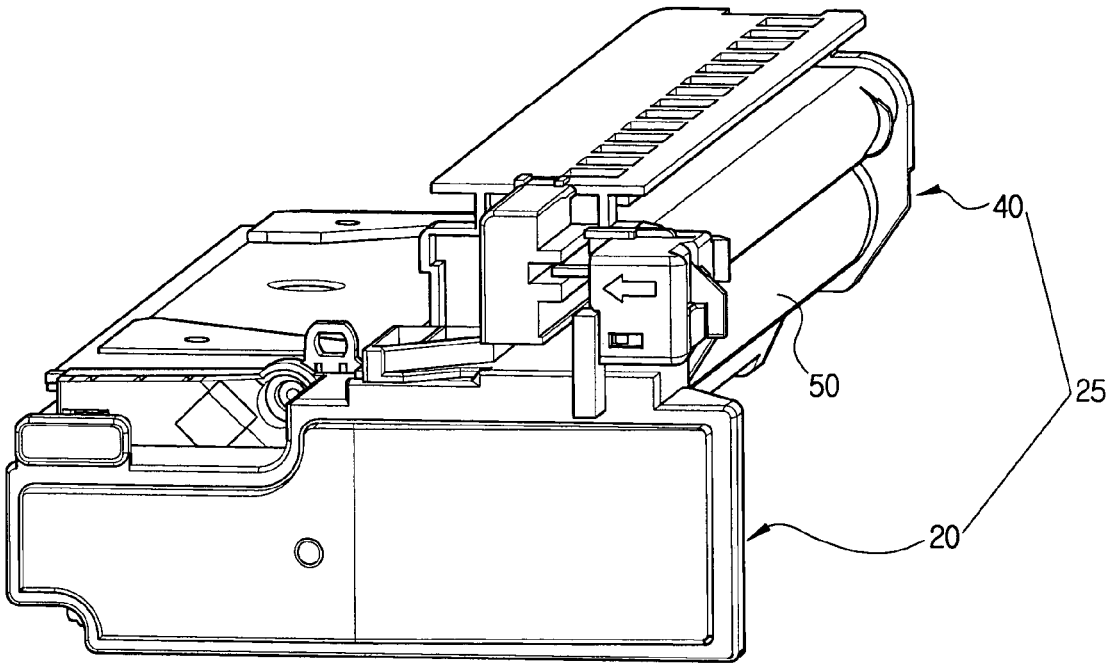
FIG. 4 is a front view showing a first unit and a second unit of FIG. 3 mounted in a mounting portion of a main body.

Referring to FIGS. 2-4, an image forming apparatus includes a main body 100 having a mounting portion 92 opened to the front, a side door unit 62 pivotably mounted at a flank of the main body 100, and a developing unit 25 detachably mounted in the mounting portion 92 and including a first unit 20 and a second unit 40.

A front door 90 is pivotably mounted on the front of the main body 100 to open and close the mounting portion 92. In the mounting portion 92, the developing unit 25 including the respective first and the second units 20 and 40 are mounted, and this will be described in greater detail hereinbelow. In addition, a paper supplying unit 23 is mounted under the mounting portion 92 to store and supply printing papers to the developing unit 25.

The side door unit 62 is hinged at the main body 100 by a lower part thereof to open and close the flank of the main body 100. The side door unit 62 includes a transfer roller (not shown) and a feeding roller (not shown). The transfer roller contacts a photoconductive drum mounted in the second unit 40 when the developing unit 25 is mounted in the mounting portion 92, and the paper passes through between the transfer roller and the photoconductive drum.

The developing unit 25 is mounted in the mounting portion 92 so that the first and the second units 20 and 40 are complementarily engaged with each other, as shown in FIG. 4. A photoconductive drum 50 of the second unit 40 forms an electrostatic latent image by a light scanned by a laser scanning unit (not shown). By closing the side door unit 62 as the second unit 40 is mounted in the mounting portion 92, the photoconductive drum 50 and a transfer roller (not shown) are disposed so as to rotate in contact with each other.

Figure 5:
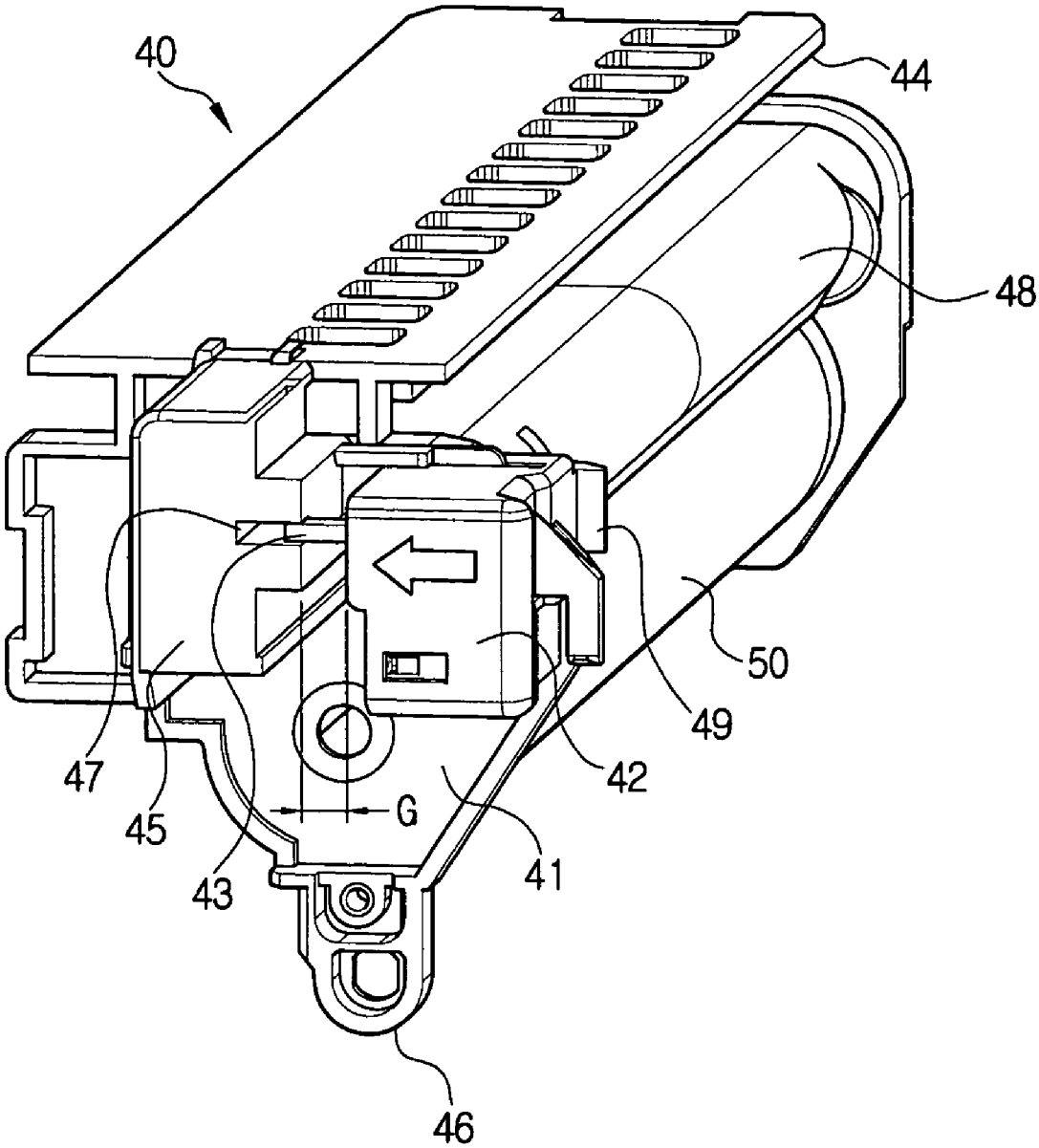
FIG. 5 is a perspective view of the second unit.

Referring to FIG. 5, the second unit 40 includes a front frame 41, a photoconductive drum 50, a waste-toner transfer part 48, a sliding guide member 44, a hook operation member 42 and a guide member 45.

The front frame 41 is provided at the front of the second unit 40, with the component parts of the second unit 40 engaged and operated integrally. More specifically, the hook operation member 42 and the guide member 45 are mounted at a front portion of the front frame 41, and the sliding guide member 44 is mounted at the top of the front frame 41. The waste-toner transfer part 48 and the photoconductive drum 50 are mounted at a rear portion of the front frame 41. A connection member 46 is formed at a lower part of the front frame 41, for engagement with a protrusion (not shown) formed at a rear portion of a waste toner storage part 22 (shown in FIG. 6) when the first and the second units 20 and 40 are engaged and mounted in the mounting portion 92.

The photoconductive drum 50 is disposed in a lengthwise direction of the second unit 40, with one end engaged with a rear side of the front frame 41. The photoconductive drum 50 is rotatably mounted to the mounting potion 92 in contact with a transfer roller (not shown) formed at the side door unit 62 (of FIG. 2).

The waste-toner transfer part 48 is disposed above the photoconductive drum 50, with one end engaged with the rear side of the front frame 41. The waste-toner transfer part 48 separates and collects residual toner from the photoconductive drum 50 and transfers the collected toner to the waste toner storage part 22 (shown in FIG. 6).

The sliding guide member 44 is connected by one end to an upper part of the front frame 41 to connect the second unit 40 to the mounting portion 92 of the main body 100. The sliding guide member 44 is formed in a length direction of the second unit 40, and therefore is received in the mounting portion 92 in a sliding manner, along a groove (not shown) integrally formed in the mounting portion 92 of the main body 100.

The hook operation member 42, in a substantially cubic configuration, is mounted on the upper part on the front of the front frame 41. A hook 49 is projected at one side of a rear surface of the hook operation member 42. The hook 49 is fixed in a recess 94 (shown in FIG. 7), which will be described hereinbelow, to fix and release the second unit 40 to the mounting portion 92 of the main body 100. A guide projection 43 is formed at the opposite side of the hook operation member 42.

The guide member 45 is mounted on an upper part of the front frame 41 in a manner that a rear portion of the guide member 45 is mounted at one side of the hook operation member 42. One side of an upper part of the guide member 45 is connected to the sliding guide member 44. The guide member 45 guides a movement of the hook operation member 42 in a direction of an arrow marked on the hook operation member 42. A guide groove 47 is formed corresponding to the guide projection 43 of the hook operation member 42 to receive the guide projection 43 as the hook operation member 42 moves in the arrow direction. In order to separate the second unit 40 from the mounting portion 92 of the main body 100, the hook operation member 42 is moved in the arrow direction, so that the hook 49 escapes from the recess 94 (shown in FIG. 7) on the mounting portion 92. Here, the guide projection 43 formed on the hook operation member 42 is received along the guide groove 47 of the guide member 45.

A gap G denotes a moving range of the hook operation member 42 when the hook operation member 42 is moved in the arrow direction for separation of the second unit 40 from the mounting portion 92.

Figure 6:
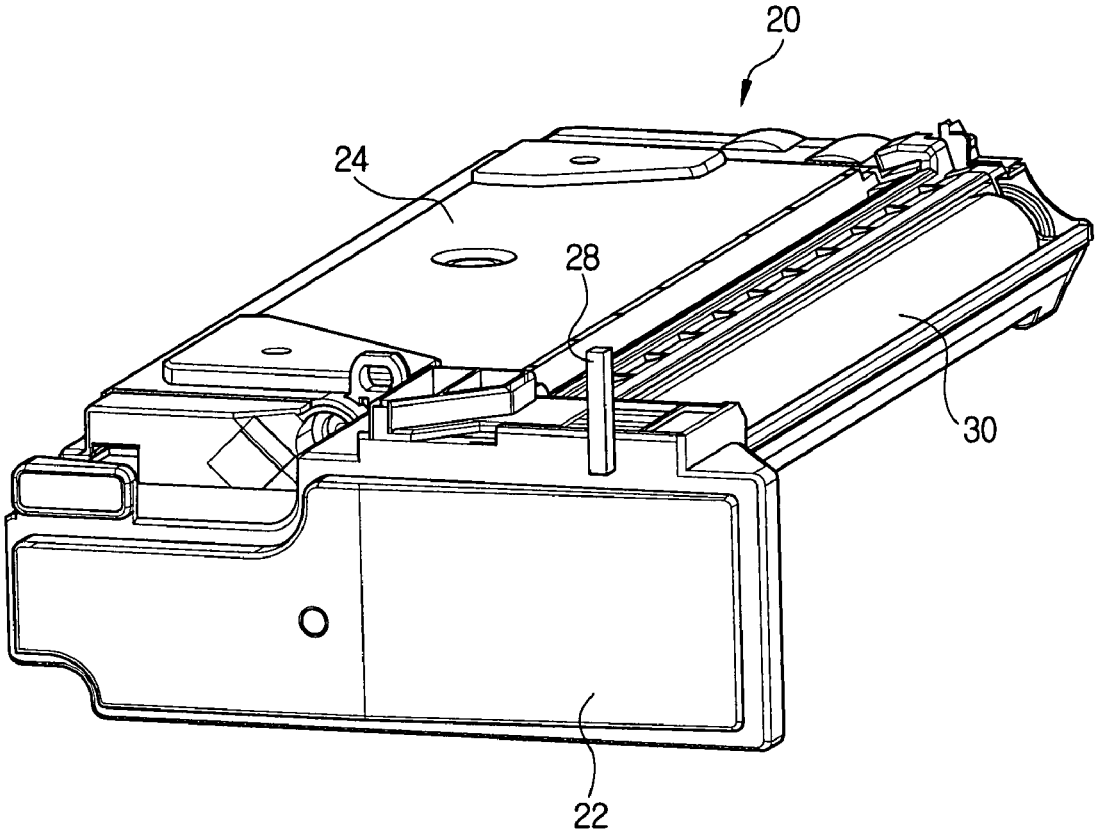
FIG. 6 is a perspective view of the first unit.

Referring to FIG. 6, the first unit 20 includes a developing roller 30, a toner container 24, the waste toner storage part 22 and a holding member 28.

The developing roller 30 is disposed in a lengthwise direction of the first unit 20. The second unit 40 supplies the toner to the photoconductive drum 50 of FIG. 5 as the respective first and the second units 20 and 40 are mounted in the mounting portion 92 of FIG. 2, being in engagement with each other.

The toner container 24 is disposed in a lengthwise direction of the first unit 20 corresponding to the developing roller 30 so as to contact with the developing roller 30. The toner container 24 stores the toner therein to supply the developing roller 30 with the toner. The toner container 24 includes a toner doctor-blade (not shown) to uniform the toner layer on the developing roller 30.

Referring to FIGS. 5 and 6, the waste-toner storage part 22, being disposed on a front of the second unit 20, stores a waste toner moved by the waste-toner transfer part 48 of the second unit 40. The waste-toner storage part 22 covers front sides of the developing roller 30 and the photoconductive drum 50 when the respective first and the second units 20 and 40 are mounted in the mounting portion 92, such that the photoconductive 50 is not exposed to a direct ray of light when the front door 90 is opened. This is because the photoconductive drum 50 is likely to be damaged by the ray of light.

The holding member 28 is disposed at an upper part of the waste-toner storage part 22 to prevent the second unit 40 from being separated from the main body 100 prior to the first unit 20 when the first and the second units 20 and 40 are mounted in the mounting portion 92 in engagement with each other. As shown in FIG. 5, the hook operation member 42 is moved in the arrow direction for separation of the second unit 40, and at this time, the holding member 28 restricts the movement of the hook operation member 42 in the arrow direction.

The holding member 28 is disposed at a location for restriction of the movement of the second unit 40 in the arrow direction. However, since the hook operation member 42 should be moved to the arrow direction for separation of the second unit 40, the holding member 28 is disposed in the gap G in which the hook operation member 42 moves in the arrow direction, such that the hook operation member 42 is not moved by the hook operation member 42.

Although the holding member 28 is not limited in shape and size as long as it can restrain the movement of the hook operation member 42, the present embodiment employs the holding member 28 as a square pole, which is protruded on the upper part of the first unit 20 in substantially vertical direction, as shown in FIG. 6.

Figure 7:
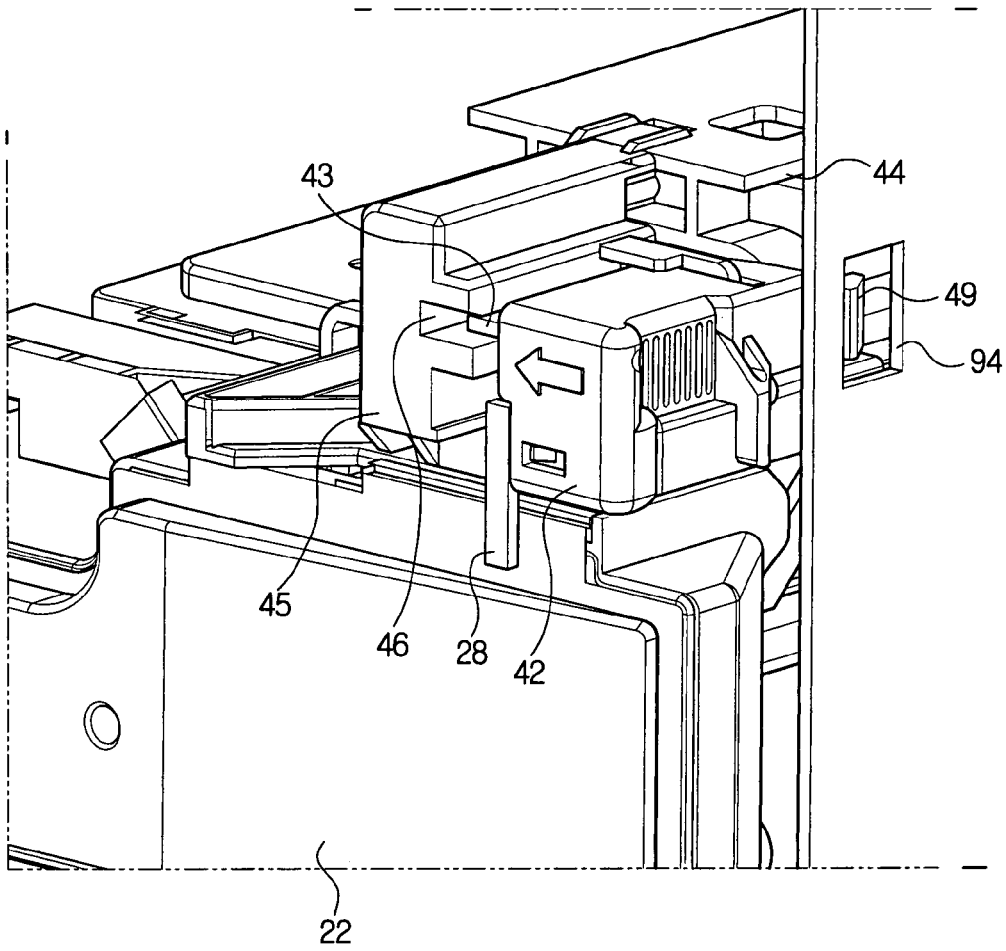
FIG. 7 is a partially-enlarged front view of the first and the second units being mounted in the mounting portion of the main body of the image forming apparatus of FIG. 2.

FIG. 7 shows the respective first and the second units 20 and 40 of FIG. 4 mounted in the mounting portion 92 of FIG. 2. As shown in FIG. 7, the second unit 40 is not separated from the main body 100 of FIG. 1, due to the holding member 28, before the first unit 20 is separated.

The recess 94 is located in the mounting portion 92. When mounting the second unit 40 in the mounting portion 92, the hook 49 formed on the hook operation member 42 comes to engagement with the recess 94, and accordingly, the second unit 40 is fixed to the main body 100 of FIG. 1.

Due to the holding member 28 being disposed in the gap G (shown in FIG. 5), which is a space for the hook operation member 42 of the second unit 40 to move for separation of the second unit 40, the hook operation member 42 cannot move in the arrow direction 42. Therefore, the hook 49 of the hook operation member 42 is not released from the recess 94, thereby preventing the second unit 40 from being separated from the main body 100.

Therefore, for separation of the developing unit 25 which includes the first and the second units 20 and 40, the front door 90 (shown in FIG. 2) is opened first, and the first unit 20 is separated prior to the second unit 40. The separating operation will be described hereinbelow.

Figure 8:
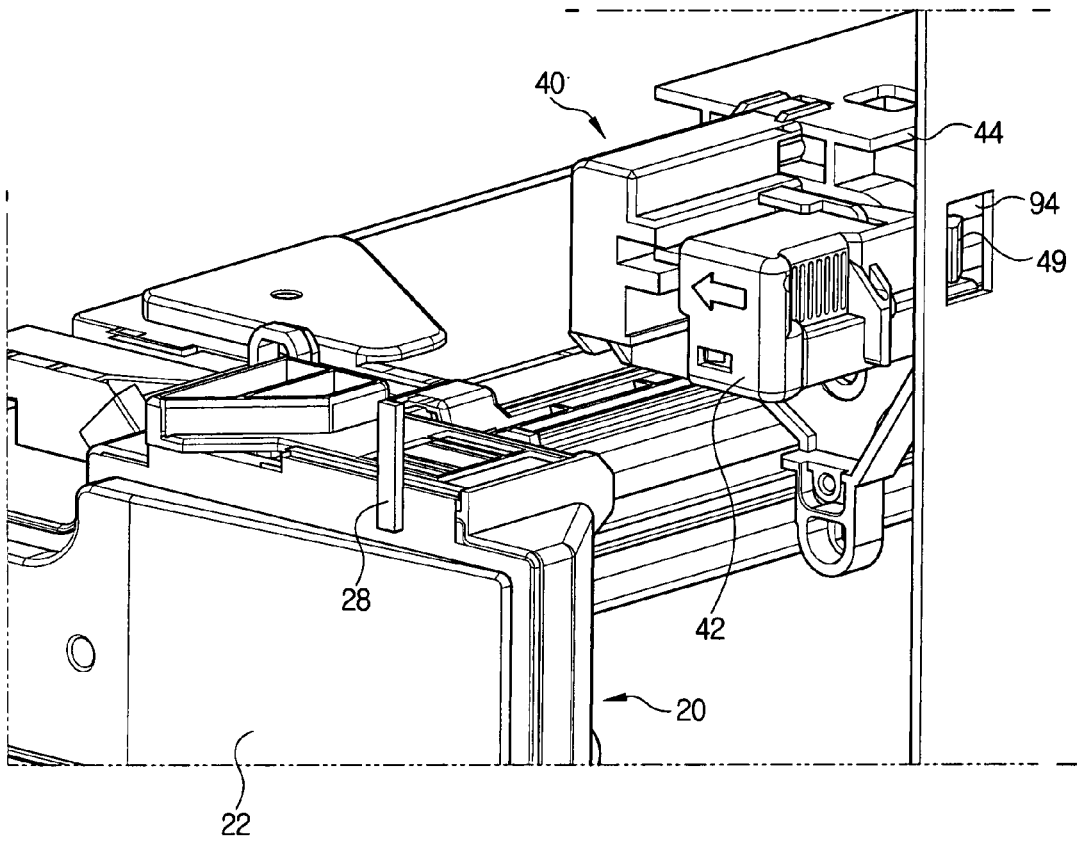
FIG. 8 is a partially-enlarged front view showing a state that the first unit is separated first from the main body.

FIG. 8 illustrates a state in which the first unit 20 is separated first from the main body 100. Since the holding member 28 of the first unit 20 does not exist, which prevents the movement of the hook operation member 42, the second unit 40 can be separated from the main body 100.

More specifically, when the hook operation member 42 is pushed in the arrow direction to separate the second unit 40 from the main body 100, the hook 49 formed on the hook operation member 42 is moved in the same direction as the hook operation member 42. Accordingly, the hook 49 is released from the recess 94 of the mounting portion 92, and the second unit 40 can be separated from the main body 100 of FIG. 2. By the movement of the hook operation member 42, the guide projection 43 of the hook operation member 42 is moved along the guide groove 47 formed on the guide member 45. The hook operation member 42 moves by the range of the gap G of FIG. 5.

Accordingly, by separating the first unit 20 having the holding member 28, the second unit 40 becomes separable from the main body 100.

In the above-described embodiment, the holding member 28 is disposed in the gap G which is the space for movement of the hook operation member 42 of the second unit 40, such that the second unit 40 is prevented from being separated first when the first and the second units 20 and 40 are mounted in the mounting portion 92. However, the present invention is not limited to this embodiment as far as the holding member 28 is able to obstruct the separation of the second unit 40.

Figure 9:
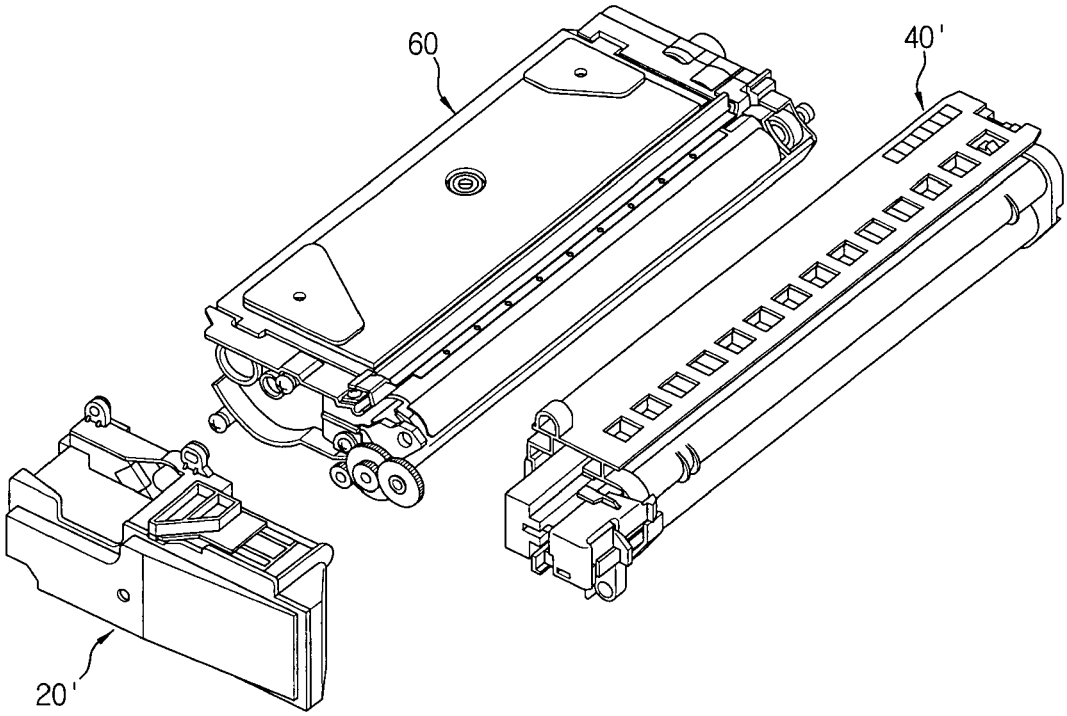
FIG. 9 is an exploded perspective view of the developing unit of FIG. 2.

In addition, although the holding member 28 of the first unit 20 prevents the second unit 40 from being separated according to this embodiment, other embodiments are contemplated. For example, if the developing unit includes at least three units 20', 40'. and 60. respectively (as shown in FIG. 9), priority of separation can be determined using the same methods as described above. Furthermore, not only the holding member 28 but also any other means, provided to a unit separated prior to another unit, can be employed if it can prevent prior separation of the another unit.

As can be appreciated from the above description of the image forming apparatus which includes the developing unit 25 including at least two units, by forcibly giving priority for separation with respect to the plurality of units, component parts of the developing unit can be protected from damage by mounting and detaching, thereby lengthening the lifespan of the parts. Especially, damage of significant and delicate parts such as the photoconductive drum or the developing roller can be prevented when the units are mounted and detached, and as a result, image quality can also be improved.

Although an embodiment of the present invention have been shown and described, the present invention is not limited to the described embodiment. Instead, it would be appreciated by those skilled in the art that changes may be made to the embodiment without departing from the principles and spirit of the invention, the scope of which is defined by the claims and their equivalents.

What is claimed is:

1. An image forming apparatus, comprising:

a main body having a mounting portion; and a developing unit detachably mounted in the mounting portion and having a first unit separated from the main body, a second unit laterally separated from the first unit, and a holding member for preventing the second unit from being dismounted from the mounting portion prior to the first unit.

2. The image forming apparatus of claim 1, wherein the second unit has a hook operation member which includes a hook for fixing and releasing the second unit with respect to the mounting portion.

3. The image forming apparatus of claim 2, wherein the holding member is disposed in a gap which is a moving path of the hook operation member to restrain movement of the hook operation member.

4. The image forming apparatus of claim 3, wherein the holding member is disposed at the first unit.

5. The image forming apparatus of claim 4, wherein the holding member protrudes from an upper part of the first unit in a substantially vertical direction.

6. The image forming apparatus of claim 5, wherein the holding member is a substantially square pole.

7. The image forming apparatus of claim 1, wherein the mounting portion is opened and closed by a front door.

8. The image forming apparatus of claim 1, wherein the second unit includes a photoconductive drum and the first unit includes a developing roller which supplies toner to the photoconductive drum.

9. An image forming apparatus having a developing unit, comprising:

a main body having a mounting portion; and a developing unit detachably mounted in the mounting portion, and having a photoconductive drum and a developing roller for supplying a toner to the photoconductive drum, wherein the developing unit includes at least three units and a holding member which dictates a specified order of dismounting the at least three units from the mounting portion.

10. A developing unit for an image forming apparatus having a mounting portion which receives the developing unit, comprising:

a first unit having a holding member, a toner container containing toner, and a developing roller; and a second unit having a photoconductive roller, wherein the holding member prevents the second unit from being dismounted from the mounting portion before the first unit, and wherein the image forming apparatus includes a recess and the second unit has a connection section which engages the holding member and the recess.

11. The developing unit of claim 10, wherein the first and second units are engaged with each other when mounted in the mounting portion.

12. A developing unit for an image forming apparatus having a mounting portion which receives the developing unit, comprising:

at least two units which are separable and removable from the mounting portion; and a holding section which dictates a priority of dismounting of the at least two separate units from the mounting portion, wherein one of the units has a movable hook fixing and releasing the unit, the hook being movable from a fixing position in which the hook is engaged with a recess in an exterior wall of the main body to a releasing position in which the hook escapes from the recess.

13. The developing unit of claim 12, wherein one of the units has a photoconductive drum, another unit has a developing roller, and the unit having the developing roller is dismounted before the unit having the photoconductive drum in the priority of dismounting.

* * * * *